US005524781A

United States Patent [19]

Podd et al.

[11] Patent Number: 5,524,781

[45] Date of Patent: Jun. 11, 1996

[54] BULK LIQUID TRANSPORT CONTAINER

[76] Inventors: Victor I. Podd, 2582 NW. 59th St., Boca Raton, Fla. 33496; Stephen D. Podd, 1321 Sherbrooke Street, West, Apt. E1, Montreal, Quebec, Canada, H3G-1J4

[21] Appl. No.: 115,208

[22] Filed: Sep. 1, 1993

[51] Int. Cl.[6] ..... B65D 88/16

[52] U.S. Cl. ..... 220/1.5; 220/403; 383/108; 383/103

[58] Field of Search ..... 383/107, 108, 383/100, 103; 220/403, 1.5, 470

[56] References Cited

U.S. PATENT DOCUMENTS

| | | | |
|---|---|---|---|
| 2,508,906 | 5/1950 | Cunningham et al. | 220/470 |
| 2,630,236 | 3/1953 | Arkoosh | 220/9 |
| 2,712,797 | 7/1955 | Woehrle et al. | 105/367 |
| 2,764,950 | 10/1956 | Finnell | 105/369 |
| 2,803,491 | 8/1957 | Brown | 296/39 |
| 2,991,906 | 7/1961 | Eligoulachvili | 220/63 |
| 3,339,474 | 9/1967 | Lamp, Jr. et al. | 99/271 |
| 3,384,106 | 5/1968 | Isbrandtsen | 220/403 |
| 3,386,605 | 6/1968 | Lafont | 220/1.5 |
| 3,416,762 | 12/1968 | Headrick | 248/361 |
| 3,462,027 | 8/1969 | Puckhaber | 214/10.5 |
| 3,756,469 | 9/1973 | Clark et al. | 222/105 |
| 3,951,284 | 4/1976 | Fell et al. | 220/1.5 |
| 4,054,226 | 10/1977 | Bjelland et al. | 220/63 R |
| 4,230,061 | 10/1980 | Roberts et al. | 114/74 A |
| 4,441,627 | 4/1984 | Takeuchi | 220/461 |
| 4,557,400 | 12/1985 | Clarke | 222/105 |
| 4,865,096 | 9/1989 | Schober et al. | 383/107 |
| 4,874,621 | 10/1989 | Loughrin | 220/403 |
| 4,875,596 | 10/1989 | Lohse | 220/403 |
| 4,909,156 | 3/1990 | Erickson | 105/359 |
| 4,941,589 | 7/1990 | Chen | 220/403 |
| 4,968,624 | 11/1990 | Bacehowski et al. | 220/403 |
| 5,024,346 | 6/1991 | Roser | 220/401 |
| 5,031,792 | 7/1991 | Russo, Sr. | 220/403 |
| 5,038,960 | 8/1991 | Seery | 220/403 |
| 5,050,765 | 9/1991 | Roser et al. | 220/401 |
| 5,244,332 | 9/1993 | Krein et al. | 220/403 |

FOREIGN PATENT DOCUMENTS

| | | | |
|---|---|---|---|
| 2226300 | 6/1990 | United Kingdom | 220/470 |
| 2228468 | 8/1990 | United Kingdom | 220/470 |

*Primary Examiner*—Stephen J. Castellano
*Attorney, Agent, or Firm*—John C. Smith

[57] ABSTRACT

A bulk liquid container constructed of semi-rigid material which has an integral outer wall to limit leakage. A single endless inner seal and an optional dual outer seal reduces the risk of leakage. The container is constructed with a single layer of material and is suitable for a wide variety of uses including food transport. Stability of the container is enhanced by a self forming convex upper layer designed to reduce surging of the liquid when the container is transported. The container can be completely filled under pressure by venting air from a vent near the apex of the convex upper layer. The semi-rigid nature of the material further acts to reduce the surging motion of the liquid when the vehicle containing the bulk liquid container is in motion. The use of retaining straps is not required. An optional bulkhead designed for rapid installation and removal, as well as remote vent, fill and empty lines for ease of use and worker safety are also provided. The bulk liquid container is also useful static standalone storage.

5 Claims, 11 Drawing Sheets

Prior Art

Prior Art

BULK LIQUID TRANSPORT CONTAINER

BACKGROUND OF THE INVENTION

1. Technical Field

The present invention relates to liquid containers. In particular, containers designed for bulk transport of liquids by commercial transport vehicles.

2. Background Art

Transportation of liquids in bulk quantities has been implemented using a variety of methods. A common method is to use a vehicle designed solely for liquid transport. Vehicles of this type are available in both motor and rail transport forms. A disadvantage to this type of transport solution is that because the vehicle is designed for liquid cargo, it creates a backhaul problem. A backhaul is the cargo carried by the vehicle on the the probability that cargo will be carried in both directions of the trip and therefore reduces the productivity of the vehicle. In addition to the backhaul problem, the costs involved with cleaning and inspection of a vehicle designed for liquid cargo increase the cost of the cargo. For example, when the vehicle is used to carry food products, great care must be used to avoid contamination. For these reasons, it is desirable that a general purpose vehicle be provided the ability to carry liquid cargo.

Attempts have been made to use general purpose vehicles for transport of liquid cargo. One known method has been to secure a deformable liner to the inside walls of a cargo vehicle. The bottom of the liner rests on the floor of the vehicle. As the vehicle is loaded, the liquid presses the liner against the floor and walls of the vehicle. While useful for some types of cargo, this method is undesirable for food or other products which may be subject to contamination. Additionally, since the cargo is unrestrained, movement of the vehicle may cause a surging weight shift which can destabilize the Vehicle. Baffles have been used to reduce the surging problem in this type of container. However, the baffles increase the cost of the liner, increase the surface area exposed to the cargo which increases the possibility of contamination, and have a relatively limited effect on surging due to the high mass of most liquid cargos.

Shipment of bulk liquids has also been accomplished by first loading the liquids into drums and then securing the drums inside the transport vehicles. While tending to reduce the exposure to air which may contaminate some cargo, this method has proven to be unsuitable for most food items due to the remaining possibility of contamination, and the desirability of avoiding metal contact with the food items. Likewise, surging problems still exist within each drum due to the presence of air pockets in the top of the drum. A further disadvantage to this method is the high cost of using drums for shipment. Not only are the drums themselves expensive, but filling, loading and unloading are expensive labor consuming activities. In addition, as the drums are loaded onto the vehicle, they must be restrained or else the movement of the vehicle may cause the drums to be damaged or overturned in transit. The expense of using drums is further increased due to the need to provide pallets to rest the drums on during transit. The drums must be disposed of or returned. In the first instance, the cost of the pallets become part of the cost of the cargo. In the second instance, the space taken by the pallets during the return trip reduces the amount of usable cargo space.

Bag, or pillow, containers have been developed which are sealed to prevent exposure to ambient air. These containers typically have air pockets which allow surging when the vehicle is in motion. To avoid movement of this type of container, restraining straps are used to hold the bag in place. In addition to the straps, bulkheads are often required to hold the ends of the bags in place when vehicle doors are opened. Bulkheads are typically expensive and time consuming to install. An additional problem associated with bags is that when they are punctured, or if a seal breaks, an entire cargo can be lost due to drainage. Further, these bags often require inner liners when transporting food stuffs or other items requiring approval from government agencies such as the U.S. Food and Drug Administration.

A problem associated with all of the prior forms of bulk liquid containers is that they often are too expensive to use for a single delivery and then be discarded. This necessitates an expensive cleaning process prior to each use as well as the cost of storage between uses.

While addressing the basic desirability of using general purpose transport vehicles to move bulk liquid cargo, the prior art has failed to provide a single bulk transport system for liquids which is inexpensive to manufacture, has a minimum number of seals to avoid leakage, minimizes leakage in the event of a puncture or seal failure, reduces contamination due to exposure to ambient air or air pockets, and can be used without straps or other restraining devices.

SUMMARY OF THE INVENTION

The present invention solves the foregoing problems by providing a bulk liquid container constructed of semi-rigid material which has an integral outer wall to limit leakage. Seal leakage is reduced through the use of a single endless inner seal and an optional dual outer seal. The material is suitable for food storage without the use of an inner liner. A self forming convex upper layer which is vented at the top of the apex allows liquid to completely fill the container under pressure. The convex shape and the semi-rigid nature of the material further act to reduce the surging motion of the liquid when the vehicle containing the bulk liquid container is in motion, thereby eliminating the need for retaining straps. An optional bulkhead designed for rapid installation and removal through the use of quick disconnect support bars, as well as remote vent, fill and empty lines for ease of use and worker safety are also provided.

DESCRIPTION OF THE PREFERRED EMBODIMENT

Figure 1:
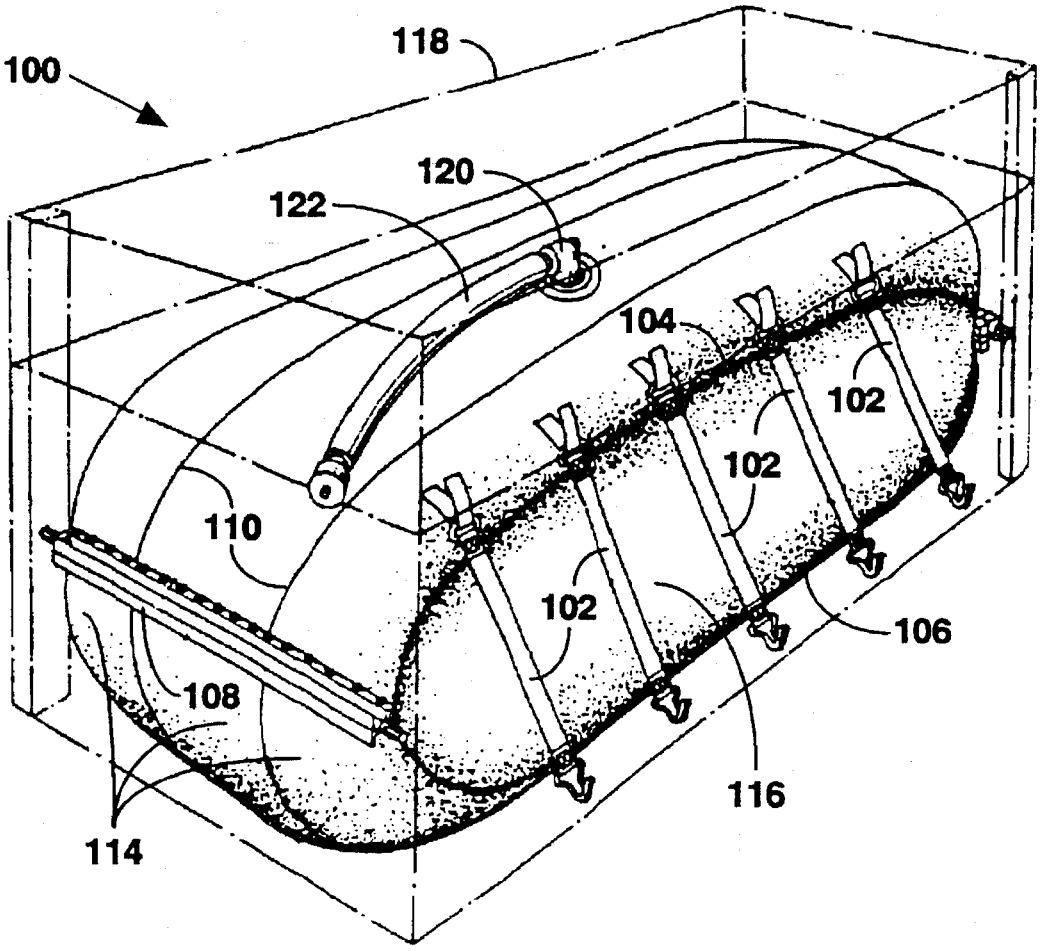
FIG. 1 is a diagram of a prior art approach.

Referring to FIG. 1, this figure shows a typical prior art approach. The bag 100 is formed from strips 114 joined by seals 110. Side panels 116 are seals on both sides of the bag 100 by seal 104 and 106. The ends of bag 100 are sealed by pressure clamps 108. Due to the number of seals 104, 106, 108, and 110, the possibility of leakage due to a seal failure is substantial.

The bag 100 is stabilized by straps 102 to prevent movement of bag 100 due to surging and sloshing of the liquid during transport of the bag 100. The straps 102 attach to bag 100 at one end and are attached to the transport vehicle 118 (shown in dashed outline form) at the other end. The straps are required due to the generally flat nature of bag 100. Due to its shape, air trapped in bag 100 allows the liquid cargo to surge and slosh during movement of vehicle 118. This surging places stress on bag 100 which can cause leaks not only in the strips of material 114, and 116, but also on seal 104, 106, 108, and 110.

As can be seen, the shape of bag 100 and the absence of a containment system allows the entire contents to bag 100 to leak out in the event of a leak. This results not only in a total loss of the cargo, but possible dangerous contamination depending on the nature of the cargo.

Finally, fill/drain attachment 120 is fitted to the top of bag 100 and fill/drain hose 122 is attached to fill/drain attachment 120. However, since bag 100 has a relatively flat upper surface, specific placement of fill/drain attachment 120 is not important since there will usually be some portion of bag 100 which contains air pockets.

Figure 2:
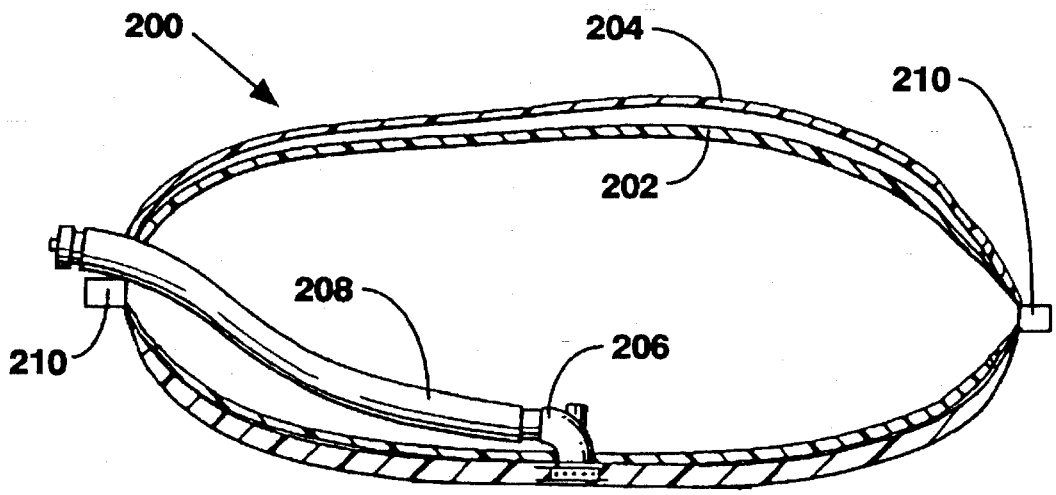
FIG. 2 is a diagram of a prior art approach.

In FIG. 2, a second prior art approach is shown. In the embodiment shown in FIG. 2, bag 200 has an outer layer 204 and inner liner 202. The inner liner 202 serves to protect against leaks and to ensure that contamination of the cargo is avoided. Inner liners 202 may also be required by government agencies depending on the materials used to construct bag 200. Of course, the addition of an inner liner 202 adds to the cost of bag 200.

Due to its shape, bag 200 is attached to supports 210 at both ends of bag 200. Supports 210 are attached at their other end to the container (not shown) holding bag 200. Supports 210 provide some restraint and also provide lift to the ends of bag 200 in an attempt to minimize some of the surging of the cargo. However, since the upper shape of bag 200 is uncontrolled, surging of cargo during movement of the vehicle is inevitable. Further, air pockets at the top of bag 200 will contribute to the ability of the cargo to surge.

Figure 3:
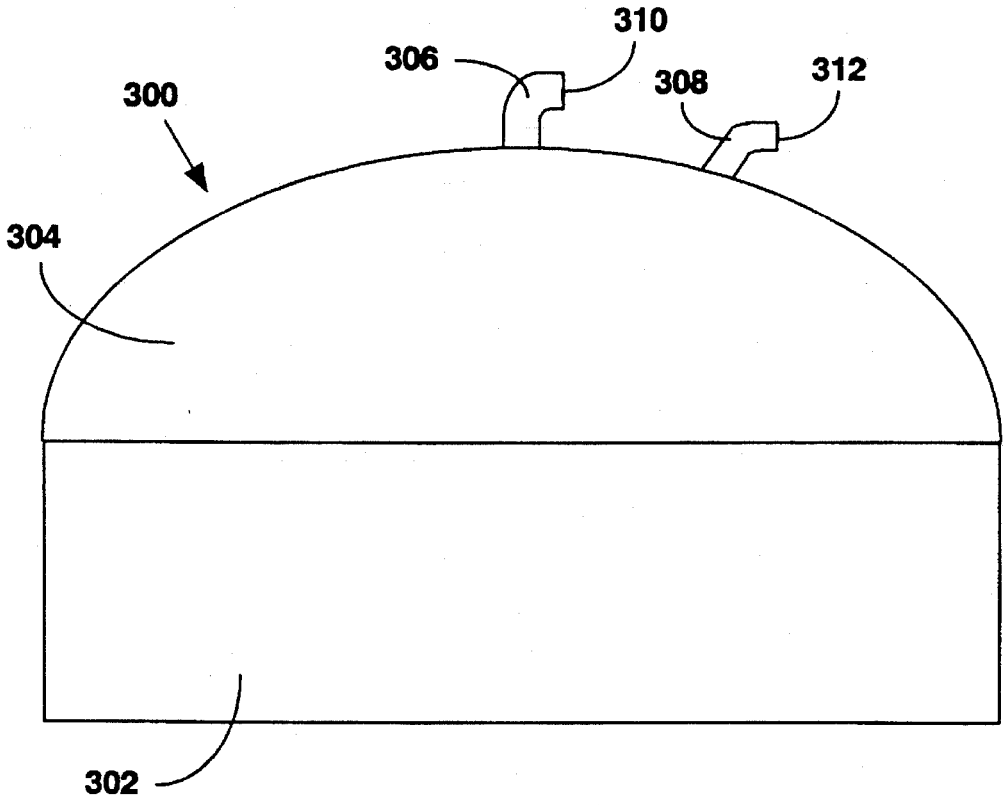
FIG. 3 is a side view of the bulk liquid transport container when filled.

FIG. 3 shows a side view of the bulk liquid container 300 (hereinafter container 300) used in the preferred embodiment when filled. The container 300 is fabricated from first and second layers of polyethylene material. For ease of illustration, they will hereafter be referred to as lower layer 500 (shown in Figure 5) and upper layer 304. Further, the perimeter portion 302 of lower layer 500 is shown in FIG. 3 as rectangular for ease of illustration, but is actually rounded at the corners as explained below in the discussion of FIG. 5. The thickness of the polyethylene in the preferred embodiment is 60 mils. However, those skilled in the art will recognize that it is possible to fabricate container 300 by sealing two sides together rather than a top and bottom layer. In addition, while a 60 mil thickness of polyethylene is used in the preferred embodiment, the thickness may vary as long as sufficient rigidity and strength is maintained.

Container 300 has a lower layer formed from a single sheet of polyethylene. Lower layer 500 has an interior portion 502 (shown below in FIG. 5) designed to rest on the floor of a transport vehicle. A perimeter portion 302 of lower layer 500 extends upward from the interior portion against the interior walls of the transport container forming a retaining wall for container 300.in the preferred embodiment, the perimeter portion extends approximately two feet up the interior walls of the vehicle. The height of the wall is not critical to the invention. As a practical matter, however, a two foot perimeter portion 302, when added to the approximately equal height provided by the upper layer 304 when container 300 is filled, provides sufficient capacity to hold the maximum weight load of a typical motor freight vehicle. Of course, those skilled in the art will recognize that changes in the weight capability of transport vehicles and changes in permissible weight loads allowed by government authorities will change the preferred height of perimeter portion 302.

The thickness of the polyethylene has been found to provide a suitable rigidity and strength for containing leaks. In the event of a leak, the rigidity of the perimeter portion 302 will enable it to hold its shape and not collapse. Therefore, leakage will cease when the upper layer 304 drops to the level of the perimeter portion 302 resulting in containment of the leak and possible salvage of a portion of the cargo which may otherwise be lost. In addition, the thickness provides sufficient strength to allow use of a single layer of polyethylene material, thereby avoiding the expense of interior liners such as those used in the prior art. Further, the thickness of the liner allows container 300 to be laid on the floor of a transport vehicle without the use of underlayment pads which might be necessary for thinner bags found in the prior art. Another advantage of container 300 is the elimination of the requirements for harness straps which add cost to prior art methods due to the cost of the harness straps and also due to the extra labor required to secure them.

As the perimeter portion 302 is folded upward against the interior walls of the vehicle, the corners of lower layer 500 act to force the corners of upper layer 304 down, which in turn results in the middle section of upper layer 302 forming a convex bulge. The formation of the convex bulge is discussed more fully in the description of FIG. 7. The convex bulge allows the top vent 306 to be inserted into container 300 at the highest point on container 300.

By venting at the highest point of container 300, air can be completely removed from container 300 when it is filled through aperture 312 of fill/drain attachment 308. Not only can the air pockets be removed, but container 300 can be filled under pressure. In turn, the removal of air from container 300 and pressure filling of container 300 eliminates the opportunity of the cargo to surge as happens in the prior art. A further limitation on surging is provided by the semi-rigid nature of container 300. The rigidity of container 300 inhibits movement of the cargo, thereby contributing further to cargo stability.

As can be seen, there are significant advantages to venting all of the air from container 300. First, the liner is able to be completely filled to capacity, creating larger payloads and improving efficiency. Second, removal of air deprives the liquid cargo of space to start a surge action, improving stability. Third, removal of the air inhibits contamination such as fermentation, mold, or mildew, improving health safety and protecting the cargo from loss of value.

Both top vent 306 and fill/drain attachment 308 may be filled and vented remotely by attaching vent and fill/drain line to apertures 310 and 312 respectively. The advantage of remote venting and fill/draining is an improvement in convenience, efficiency, and safety of workers. Three quarter inch tubing is used for the vent line in the preferred embodiment. Further, the particular shape or configuration of top vent 306 or fill/drain attachment 308 is not important so long as they are convenient to use.

Figure 4:
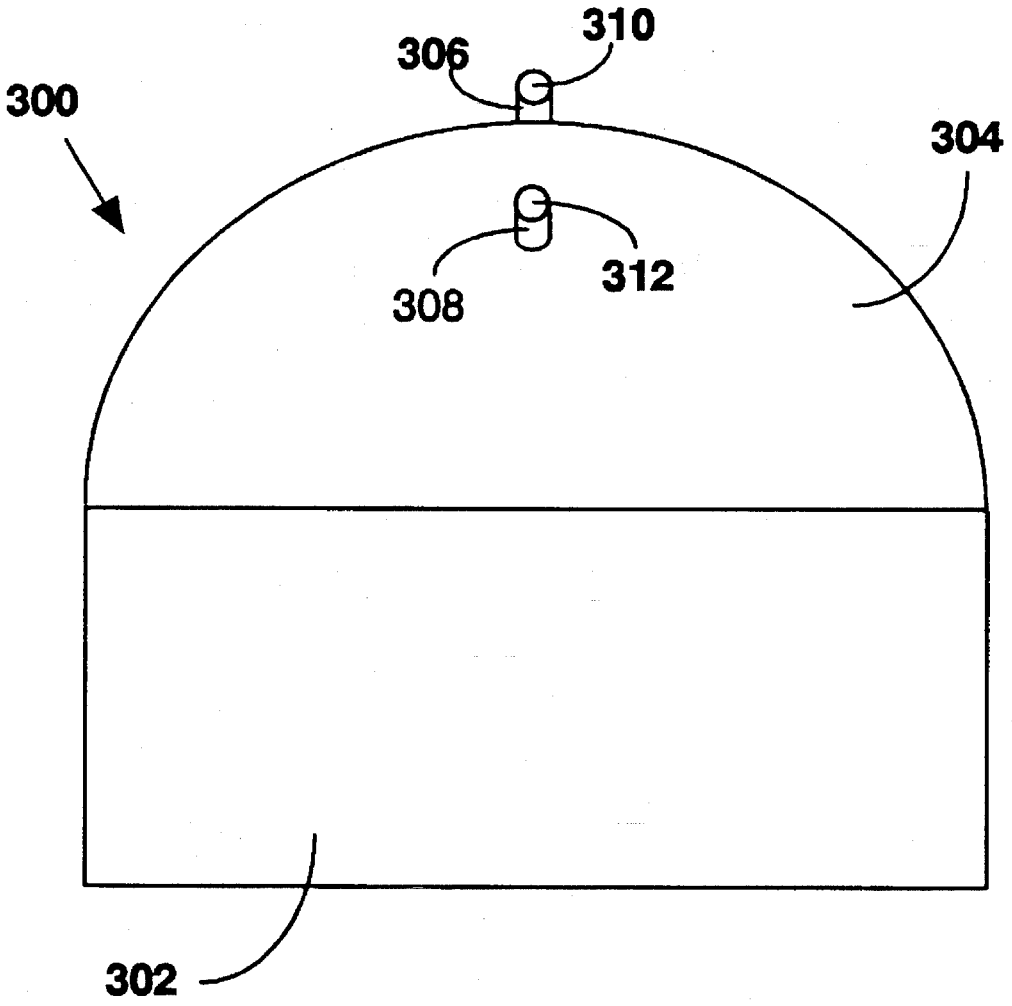
FIG. 4 is an end view of the bulk liquid transport container when filled.

FIG. 4 shows an end view of container 300 discussed above in relation to FIG. 3. Those skilled in the art will recognize that while top vent 306 should be located as close to the top of upper layer 304 as possible to facilitate removal of air pockets, fill/drain attachment 308 can be located in any convenient location since container 300 can be pressure filled. Likewise, it should be apparent that the higher fill/drain attachment 308 is located on the convex bulge, the less pressure will be required to fill container 300.

Figure 5:
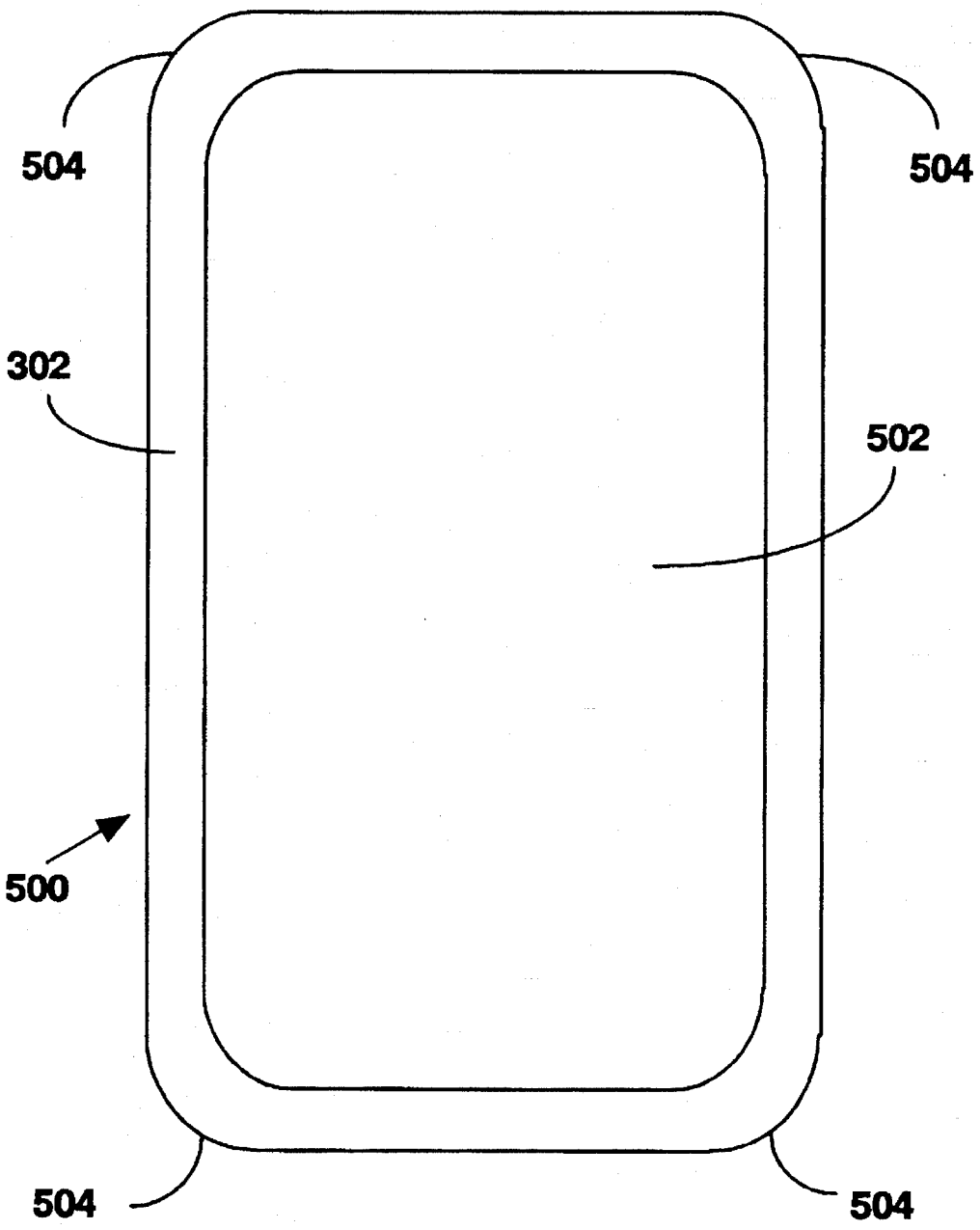
FIG. 5 is a top view of the lower layer of the bulk liquid transport container when filled.

FIG. 5 shows a top view of lower layer 500. For ease of illustration, lower layer 500 is not drawn to scale. Lower layer 500 is a single sheet having an interior portion 502 surrounded by perimeter portion 302. As discussed above, the preferred embodiment uses a two foot wide perimeter portion. Interior portion 502 would be sized to substantially fill the floor surface area of the intended transport vehicle. In the preferred embodiment, upper layer 304 (not shown) has substantially the same dimensions as lower layer 500. Therefore, as container 300 is filled, the two foot height of perimeter portion 302 is approximately doubled by the section of upper layer 304 which overlays perimeter 302 and is pushed upward by the filling process. Those skilled in the art will recognize that upper layer 504 does not have to be the same size as lower layer 500. If, for example, upper layer 304 is smaller than lower layer 500, it will attach lower on the perimeter portion 302 resulting in a lower net cargo capacity. Likewise, the excess perimeter portion 302 will provide a relatively larger leak barrier.

Figure 6:
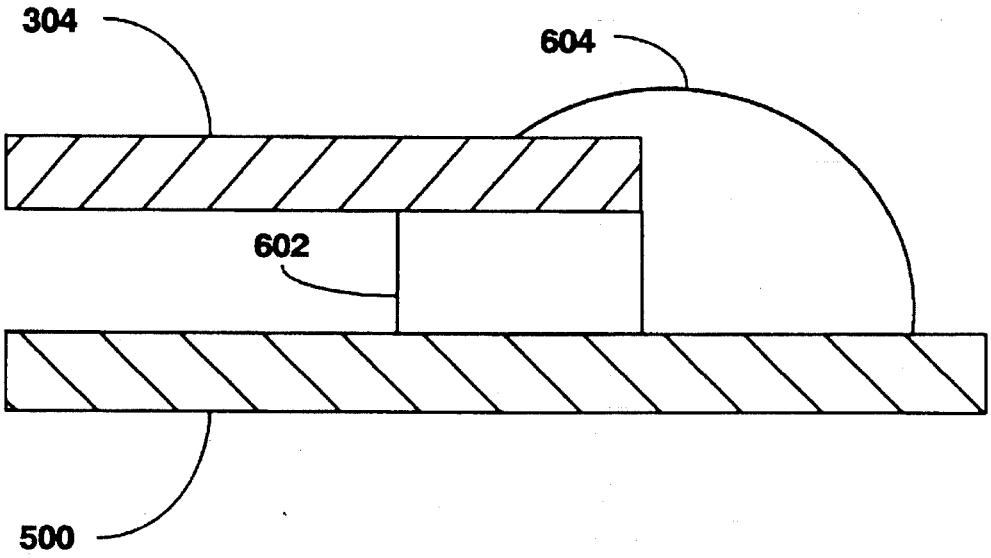
FIG. 6 is a diagram of the endless seal and the dual seal.

FIG. 6 is an end view which shows the position of the endless seal 602 in relation to upper layer 304 and lower layer 500. Endless seal 602 is created by bonding layers 304 and 500 together. The bonding can be performed by a variety of methods such as inner heat, ultrasonic or RF (radio frequency) sealing. In the preferred embodiment, a self propelled air heater is used. Self propelled air heaters are well known in the art. Endless seal 602 is an internal seal, heat sealed from the inside. An important advantage of the invention is that the endless seal allows the container 300 to be created with a single seal. Further, in the prior art, numerous seals were used resulting in greater potential for leakage, and increased manufacturing cost due to additional time and labor required to fabricate all of the seals.

While container 300 requires only the single endless seal 602 to perform, a dual seal 604 may be applied for added protection. As can be seen from FIG. 6, a slight overhang of lower layer 500 is used to provide support for the dual seal 604. This seal is preferably an extrusion weld made of the same material as the upper and lower layers 304 and 500. While the second extrusion seal is typically used in addition to endless seal 602 for an added measure of protection, either endless seal 602 or dual seal 604 can satisfactorily perform if used alone or in combination with one another. Those skilled in the art will recognize that it is possible to use layers of differing material as long as the sealing of the layers is possible. Likewise, the material used for container 300 does not have to be polyethylene. The only requirements for substitute materials are that they should not interact adversely with the chemical compositions in the cargo and they should meet government requirements for use with the particular cargo.

The distance between endless seal 602 and the edge of lower layer 500 is not critical. However, location of the seal at a distance of two to four inches from the edge of lower layer 500 has been found to provide the most efficient use of layer material while providing adequate room to apply dual seal 604.

Figure 7:
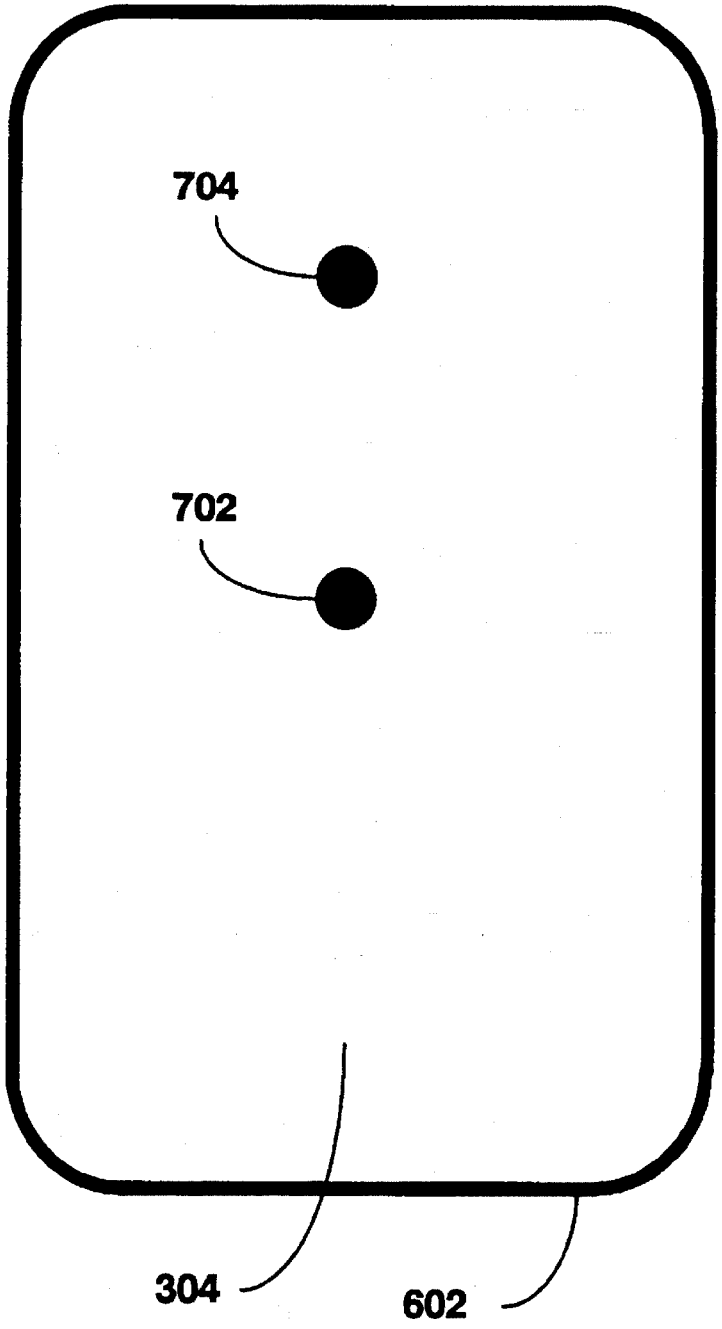
FIG. 7 is a top view of the container showing the location of the endless seal and the apertures for vent and drain/fill attachments.

FIG. 7 is a top view of container 300 shown in flat (i.e., empty) position after the endless seal 602 is completed. The path of endless seal 602 is preferably located near the outer perimeter of upper layer 304 and lower layer 500. Vent aperture 702 and fill/drain aperture 704 are cut into upper layer 304 to accept top vent 306 and fill/drain attachment 308. The location of aperture 702 is based on the expected location of the highest point when container 300 is filled which is typically in the center of container 300. The location of aperture 704 and fill/drain attachment 308 is not critical. Of course, top vent 306 and the fill/drain attachment 308 are also sealed to upper layer 304. An extrusion welder is used for this purpose in the preferred embodiment. However, a variety of other methods are suitable, including heat, ultrasonic, RF, vulcanizing, or by epoxying. Two inch diameter venting and fill/drain fittings are used in the preferred embodiment.

Also apparent from FIG. 7 is the simplicity of construction provided by the invention. As can be seen, only two sheets of material with a single endless seal are required to manufacture the basic structure of container 300, resulting in significantly reduced manufacturing costs. While the cost of manufacturing the container is inexpensive enough to allow disposal after a single use, it is reusable and recyclable.

Figure 8:
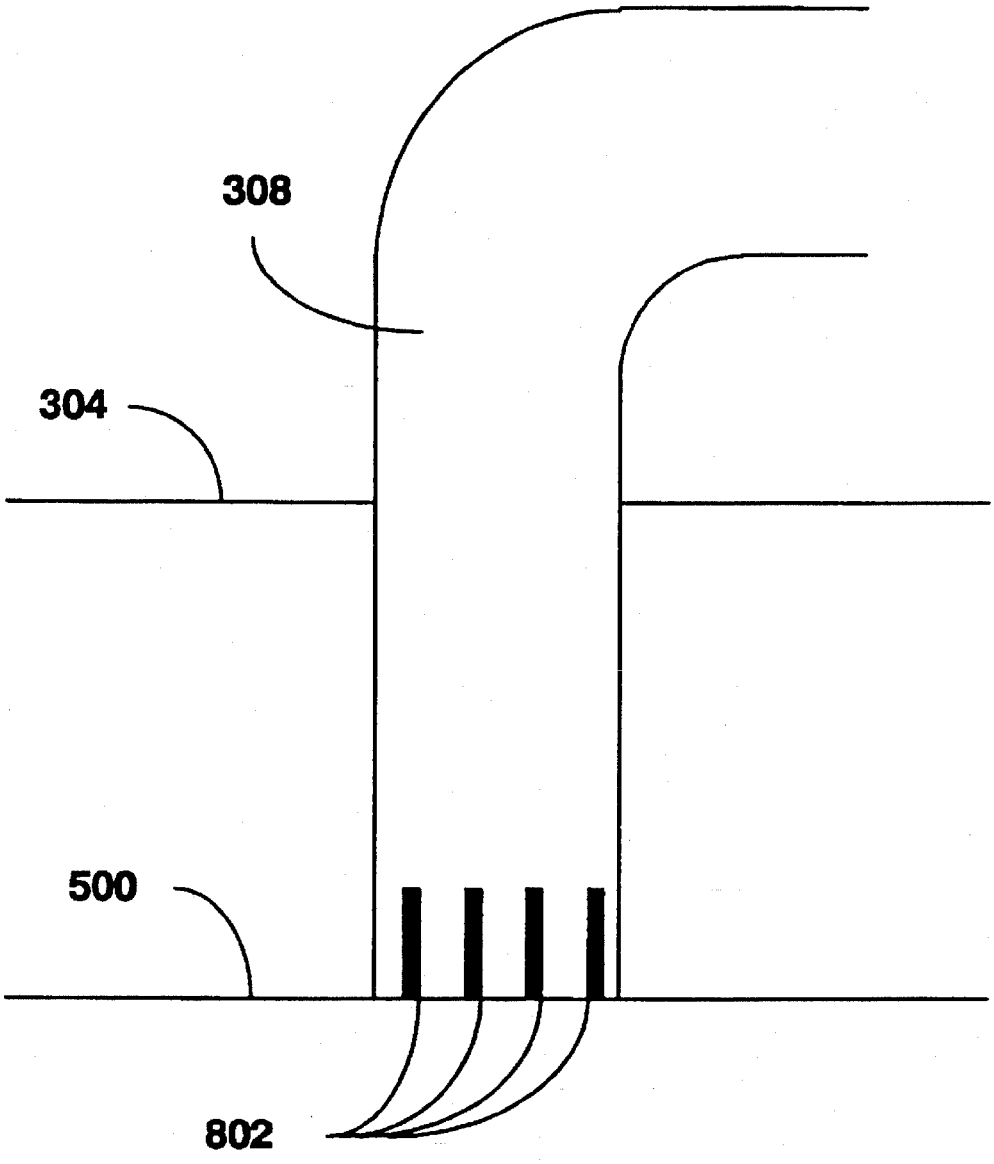
FIG. 8 is a view of the fill/drain attachment showing the liquid pickup slots at the end of the attachment.

FIG. 8 shows the liquid pickup method used by fill/drain attachment 308. Fill/drain attachment 306 extends 3–6 inches into container 300 in the preferred embodiment. When container 300 is almost empty and fill/drain attachment 308 rests on lower layer 500, liquid can still be extracted though apertures 802 in the side of fill/drain attachment 308.. By extending the fill/drain attachment 308 into container 300, air is prevented from entering the suction line which would cause the discharge pump to lose its prime and halt fluid flow from container 300.

Figure 9:
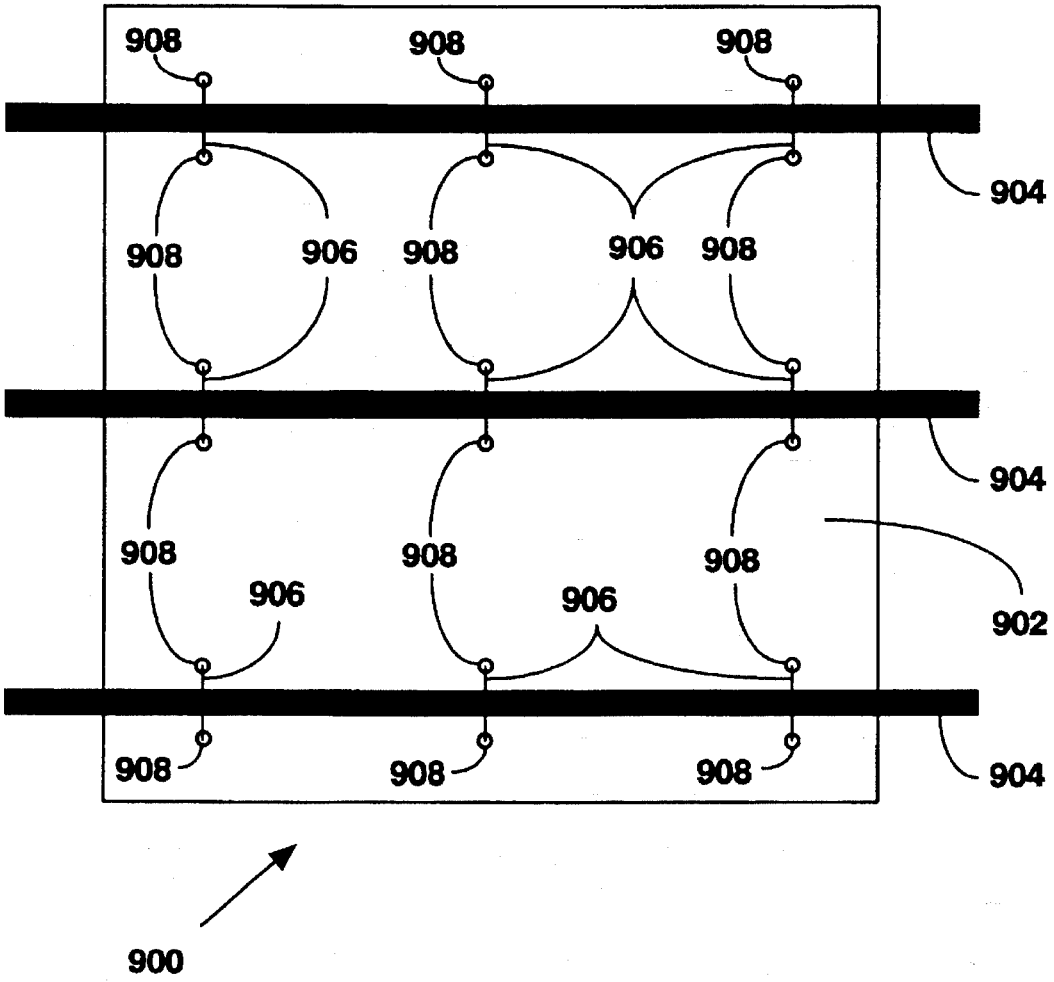
FIG. 9 is a rear view of the bulk head and support bars.

It is well known in the art to attach bulkheads to vehicle frames retain cargo when doors are open. FIG. 9 shows an improved bulkhead 900 which is low cost and is rapidly installable. Bulkhead wall 902 can be fabricated from inexpensive plywood. The preferred embodiment contemplates five eighth inch thick to three quarter inch thick plywood. Bar 904 is set into the frame of the vehicle (not shown) and attached to bulkhead wall 902 by flexible ties 906. While plywood is used in the preferred embodiment, any suitable material may be substituted. For example, corrugated fiberboard, plastic board, or corrugated sheet metal may all be substituted.

Figure 10:
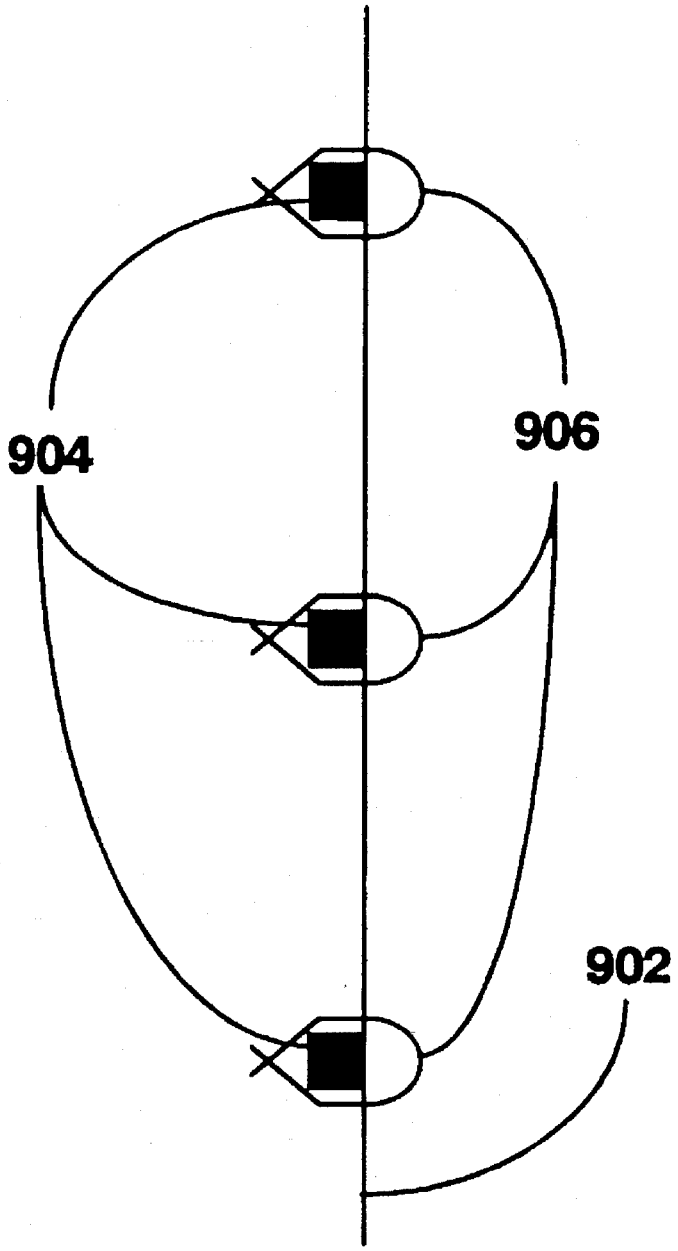
FIG. 10 is a side view of the bulk head and support bars.

As shown in FIGS. 9 and 10, one end of flexible tie 906 is passed though aperture 908 on one side of bar 904, passed back through a second aperture 908 on the other side of bar 904 and tied together with the other end of flexible tie 906 prevent movement of bar 904. Those skilled in the art will recognize that it does not matter which side of bulkhead wall 902 that flexible tie 906 is tied. After use, bars 904 and bulkhead wall 902 can be stored in a minimum amount of space.

Figure 11:
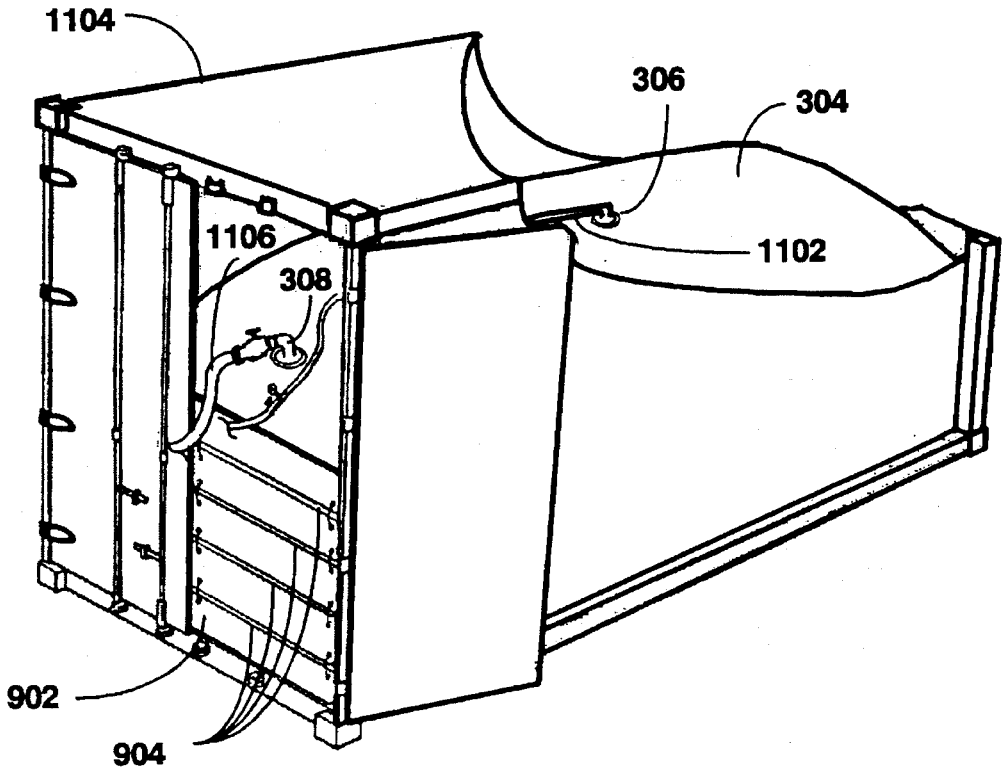
FIG. 11 is a cutaway diagram showing the placement of the container within a transport vehicle.

FIG. 11 shows container 300 fully loaded in a transport vehicle 1104. Upper layer 304 is shown through the cutaway portion of transport vehicle 1104. Top vent 306 is located at the apex of the convex bulge on upper layer 304. Remote vent line 1102 is attached to top vent 306. Fill/drain attachment 308 is placed at a convenient location for loading and unloading container 300, but can easily be located elsewhere with the use of a remote fill/drain line 1106. Bulkhead wall 902 and bars 904 are shown at the rear door of transport vehicle 1104. One door of transport vehicle is shown in the closed position. This is not required to practice the invention, but is shown in this position to illustrate an additional safety step in the event of a bulkhead failure. One skilled in the art will recognize that the appropriate size for container 300 will be determined by the type of transport vehicle 1104 selected.

In addition to use on transport vehicles, which may include a variety of modes such as container, truck, rail, ship or air, container 300 is also useful for standalone storage. In this mode, inexpensive storage is provided if inventory should reach an excessive level. Further, while the preferred embodiment uses the interior walls of the vehicle for support, smaller loads can be placed on larger vehicles by building a retention wall inside the vehicle.

While the invention has been described with respect to a preferred embodiment thereof, it will be understood by those skilled in the art that various changes in detail my be made therein without departing from the spirit, scope, and teaching of the invention. For example, the material used to construct the layers may be anything suitable for a particular cargo, the size and shape of the top vent and drain/fill attachments. Likewise, the size of the bulk liquid container may vary based on the transport vehicle's limitations, etc. Accordingly, the invention herein disclosed is to be limited only as specified in the following claims.

I claim:

1. A liquid storage container system, comprising a transport vehicle; and a liquid storage container, comprising:

a first layer having an interior portion and a perimeter portion, the interior portion substantially covers the available floor surface area of a transport vehicle, and the perimeter portion extends upwardly from the interior portion along a portion of the interior walls of the transport vehicle forming a liquid containment barrier;

a second layer sealed to the first layer by a first single endless seal such that an interior space is formed between the second layer and the first layer for liquid containment, the second layer is attached to the first layer such that a substantially convex bulge is formed in the mid portion of the second layer when the liquid storage container is filled;

a top vent attached substantially near the apex of the convex bulge;

a filling attachment inserted through the first layer or the second layer to insert and remove liquids from the interior space; and a second seal, substantially adjacent to the first seal, the first seal and the second seal forming a dual seal connecting the first layer and the second layer;

whereby the bottom portion and the perimeter portion form a seamless liquid containment barrier in the event of a seal failure.

2. A liquid storage container, as in claim 1, wherein:

the first layer is comprised of a single sheet of material; and the second layer is comprised of a single sheet of material.

3. A liquid storage container, as in claim 2, further comprising:

a remote vent line attached to the top vent for venting the liquid storage container from outside of the transport vehicle.

4. A liquid storage container, as in claim 3, further comprising:

a remote fill/drain line attached to the filling attachment for filling or draining the liquid storage container from outside of the transport vehicle.

5. A liquid storage container, as in claim 4, further comprising:

at least one bulkhead secured between a portion of the perimeter portion of the liquid storage container and the open doors of the transport vehicle, the bulkhead further comprising:

a wall portion of a size suitable to fit in the opening created by the open doors in the transport vehicle;

at least one retaining bar between the vehicle frame and the wall portion to prevent substantial movement of the wall portion;

at least one tie for holding the retaining bar in position against the portion, the tie inserted through apertures in the wall portion and secured around the retaining bar.

* * * * *